US009243212B2

(12) United States Patent
Kuppert et al.

(10) Patent No.: US 9,243,212 B2
(45) Date of Patent: Jan. 26, 2016

(54) DETERGENT FORMULATION FOR TEXTILES, COMPRISING RHAMNOLIPIDS WITH A PREDOMINANT CONTENT OF DI-RHAMNOLIPIDS

(71) Applicant: Evonik Industries AG, Essen (DE)

(72) Inventors: Dirk Kuppert, Aschaffenburg (DE); Ulrike Kottke, Linsengericht-Grossenhausen (DE); Juergen Lattich, Nidderau-Ostheim (DE); Magdalena Volk, Alzenau (DE); Hans Henning Wenk, Muelheim an der Ruhr (DE); Fabien Cabirol, Essen (DE); Martin Schilling, Bonn (DE); Steffen Schaffer, Herten (DE); Petra Allef, Essen (DE)

(73) Assignee: EVONIK DEGUSSA GMBH, Essen (DE)

( * ) Notice: Subject to any disclaimer, the term of this patent is extended or adjusted under 35 U.S.C. 154(b) by 0 days.

(21) Appl. No.: 14/243,391

(22) Filed: Apr. 2, 2014

(65) Prior Publication Data

US 2014/0296125 A1 Oct. 2, 2014

(30) Foreign Application Priority Data

Apr. 2, 2013 (DE) ..... 10 2013 205 755

(51) Int. Cl.

| | |
|---|---|
| ***C11D 1/74*** | (2006.01) |
| ***C11D 1/06*** | (2006.01) |
| ***C11D 1/37*** | (2006.01) |
| ***C11D 1/12*** | (2006.01) |
| ***C11D 1/22*** | (2006.01) |

(52) U.S. Cl.
CPC .. *C11D 1/74* (2013.01); *C11D 1/06* (2013.01); *C11D 1/37* (2013.01)

(58) Field of Classification Search
CPC ..... C11D 1/74; C11D 1/06; C11D 1/37; C11D 1/12; C11D 1/22; C11D 11/0017
See application file for complete search history.

(56) References Cited

U.S. PATENT DOCUMENTS

| | | | | |
|---|---|---|---|---|
| 3,234,258 | A | 2/1966 | Morris | |
| 5,075,041 | A | 12/1991 | Lutz | |
| 2012/0220464 | A1 | 8/2012 | Giessler-Blank et al. | |
| 2013/0035403 | A1 | 2/2013 | Schaffer et al. | |
| 2013/0130319 | A1 | 5/2013 | Schaffer et al. | |
| 2014/0080771 | A1* | 3/2014 | Leighton | 514/25 |
| 2014/0294925 | A1* | 10/2014 | Yin | 424/450 |

FOREIGN PATENT DOCUMENTS

| | | | |
|---|---|---|---|
| CA | 2053900 | | 10/1990 |
| EP | 1445302 | A1 | 8/2004 |
| EP | 2410039 | * | 1/2012 |
| EP | 2410039 | A1 | 1/2012 |
| JP | 58217598 | | 12/1983 |
| WO | WO9013533 | | 11/1990 |
| WO | WO2007115872 | A1 | 10/2007 |
| WO | WO2012010406 | A1 | 1/2012 |
| WO | WO2013037643 | A1 | 3/2013 |

OTHER PUBLICATIONS

Chen et al, Mixing Behavior of the Biosurfactant rhamnolipid with a conventional anionic surfactant, sodium dodecyl benzene sulfonate, Langmuir, Nov. 2, 2010, pp. 17958-17968.*

Henning, K., "Natuerliche Inhaltsstoffe Fuer Wasch-und Reinigungsmittel Durch Biotechnologie" SOFW-Journal Seifen, OELE, Fette, Wasche, Verlag fur Chemische Industrie, Augsburg, Germany, Jan. 2013, 139, No. 1-2, pp. 47-51.

European Search Report dated Jun. 26, 2014 received in a corresponding foreign application.

Heyd, M., et al., "Development and trends of biosurfactant analysis and purification using rhamnolipids as an example", Anal Bioanal Chem., Jul. 2008;391(5):1579-90.

* cited by examiner

*Primary Examiner* — Charles Boyer
(74) *Attorney, Agent, or Firm* — Scully, Scott, Murphy & Presser, P.C.

(57) ABSTRACT

The invention relates to detergent formulations for textiles, comprising rhamnolipids, where the content of di-rhamnolipids predominates, and to the use of certain rhamnolipid mixture compositions and of the aforementioned detergent formulations for increasing the rate of foam formation and/or for foam stabilization, and to the use of rhamnolipids for preventing the greying of a textile.

12 Claims, No Drawings

DETERGENT FORMULATION FOR TEXTILES, COMPRISING RHAMNOLIPIDS WITH A PREDOMINANT CONTENT OF DI-RHAMNOLIPIDS

FIELD OF THE INVENTION

The present invention relates to detergent formulations for textiles comprising rhamnolipids, where the content of di-rhamnolipids predominates. The present invention also relates to the use of certain rhamnolipid mixture compositions and of the aforementioned detergent formulations for increasing the rate of foam formation and/or for foam stabilization. In addition, the present invention further relates to the use of rhamnolipids for preventing greying of a textile.

PRIOR ART

Aqueous surfactant solutions exhibit different rates of foam formation and differing foam stability depending on their composition. Foam formation and disintegration are influenced by the presence of soil.

Foam stability is a quality feature important for the consumer especially when washing laundry and/or a fabric.

Detergent formulations with a high foam stability are desirable.

SUMMARY OF THE INVENTION

Surprisingly, it has been found that rhamnolipids (RL) with a high content of di-rhamnolipids in detergent formulations exhibit a more stable foam and/or more foam formation than surfactants according to the prior art, especially in the presence of a high soil burden.

Surprisingly, it has been found that the formulations described below are able to achieve the object addressed by the invention.

The present invention provides detergent formulations for textiles, comprising a rhamnolipid mixture composition with an increased fraction of di-rhamnolipids.

The invention further provides the use of certain rhamnolipid mixture compositions and of the aforementioned detergent formulations for increasing the rate of foam formation and/or for foam stabilization, and to the use of rhamnolipids for preventing greying of a textile.

It is an advantage of the invention that the surfactants used in the detergent formulation are biodegradable.

A first advantage of the formulations according to the invention is their outstanding foam stability under aqueous conditions.

A second advantage of the formulations according to the invention is their outstanding foam volume under aqueous conditions.

A third advantage of the formulations according to the invention is their exceptional foaming behavior.

A fourth advantage of the formulations according to the invention is their simple formulatability in any desired aqueous surface-active systems.

A fifth advantage of the formulations according to the invention is their good thickenability with conventional thickeners in formulations.

A sixth advantage is their good ability to be washed out of textiles.

A seven advantage of the formulations according to the invention is their mildness and good physical compatibility, in particular characterized by a high value in the red blood cell (RBC) test.

An eighth advantage of the formulations according to the invention is that they leave behind a pleasant soft feel of the textile after washing.

DETAILED DESCRIPTION OF THE INVENTION

In connection with the present invention, the term "rhamnolipid" is understood as meaning in particular compounds of general formula (I) or salts thereof, formula (I)

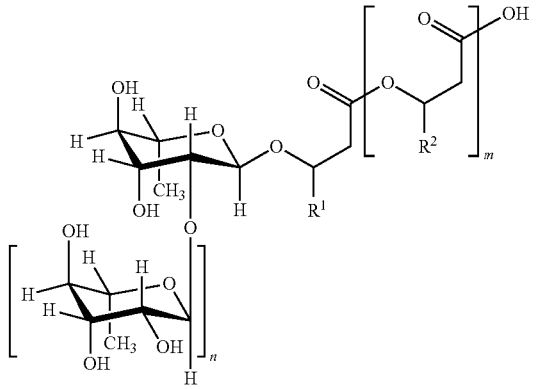

where m=2, 1 or 0, n=1 or 0, $R^1$ and $R^2$=independently of one another, identical or different organic radical having 2 to 24, preferably 5 to 13, carbon atoms, in particular optionally branched, optionally substituted, in particular hydroxy-substituted, optionally unsaturated, in particular optionally mono-, di- or triunsaturated, alkyl radical, preferably one selected from the group consisting of pentenyl, heptenyl, nonenyl, undecenyl and tridecenyl and $(CH_2)_o—CH_3$ where o=1 to 23, preferably 4 to 12.

In connection with the present invention, the term "di-rhamnolipid" is understood as meaning compounds of general formula (I) or salts thereof in which n=1.

In connection with the present invention, the term "mono-rhamnolipid" is understood as meaning compounds of general formula (I) or salts thereof in which n=0.

Distinct rhamnolipids are abbreviated according to the following nomenclature:

"diRL-CXCY" is understood as meaning di-rhamnolipids of general formula (I) in which one of the radicals $R^1$ and $R^2$=$(CH_2)_o—CH_3$ where o=X-4 and the remaining radical $R^1$ or $R^2$=$(CH_2)_o—CH_3$ where o=Y-4.

"monoRL-CXCY" is understood as meaning mono-rhamnolipids of general formula (I) in which one of the radicals $R^1$ and $R^2$=$(CH_2)_o—CH_3$ where o=X-4 and the remaining radical $R^1$ or $R^2$=$(CH_2)_o—CH_3$ where o=Y-4.

The nomenclature used thus does not differ between "CXCY" and "CYCX".

For rhamnolipids where m=0, monoRL-CX or diRL-CX is accordingly used.

If one of the aforementioned indices X and/or Y is provided with ":Z", then this means that the respective radical $R^1$ and/or $R^2$=an unbranched, unsubstituted hydrocarbon radical with X-3 or Y-3 carbon atoms having Z double bonds.

In connection with the present invention, the "pH" is defined as the value which is measured for a corresponding substance at 25° C. after stirring for five minutes using a pH electrode calibrated in accordance with ISO 4319 (1977).

In connection with the present invention, the term "aqueous" is understood as meaning a composition which comprises at least 5% by weight of water, based on the total composition under consideration.

Unless stated otherwise, all of the stated percentages (%) are percentages by mass.

Consequently, what is claimed is a detergent formulation for textiles, comprising a mono- and di-rhamnolipid mixture composition, characterized in that the weight ratio of di-rhamnolipids to mono-rhamnolipids is greater than 51:49, preferably greater than 75:25, particularly preferably 97:3, in particular greater than 98:2.

In connection with the present invention, the term "mono- and di-rhamnolipid mixture composition" means that the mixture composition according to the invention comprises mono-rhamnolipids.

Preferably, the detergent formulation according to the invention is liquid at room temperature.

One detergent formulation preferred according to the invention is characterized in that the rhamnolipid mixture composition comprises 51% by weight to 95% by weight, preferably 70% by weight to 90% by weight, particularly preferably 75% by weight to 85% by weight, of diRL-C10C10 and 0.5% by weight to 9% by weight, preferably 0.5% by weight to 3% by weight, particularly preferably 0.5% by weight to 2% by weight, of monoRL-C10C10, where the percentages by weight refer to the sum of all of the rhamnolipids present.

Another detergent formulation preferred according to the invention is characterized in that the rhamnolipid mixture composition comprises, besides the aforementioned diRL-C10C10 and monoRL-C10C10 contents, 0.5% by weight to 15% by weight, preferably 3% by weight to 12% by weight, particularly preferably 5% by weight to 10% by weight, of diRL-C10C12:1, where the percentages by weight refer to the sum of all of the rhamnolipids present.

A yet other detergent formulation preferred according to the invention is characterized in that the rhamnolipid mixture composition comprises, besides the aforementioned diRL-C10C10 and monoRL-C10C10 contents, 0.5 to 25% by weight, preferably 5% by weight to 15% by weight, particularly preferably 7% by weight to 12% by weight, of diRL-C10C12, where the percentages by weight refer to the sum of all of the rhamnolipids present.

A still further detergent formulation preferred according to the invention is characterized in that the rhamnolipid mixture composition comprises, besides the aforementioned diRL-C10C10 and monoRL-C10C10 contents, 0.1% by weight to 5% by weight, preferably 0.5% by weight to 3% by weight, particularly preferably 0.5% by weight to 2% by weight, of monoRL-C10C12 and/or, preferably and 0.1% by weight to 5% by weight, preferably 0.5% by weight to 3% by weight, particularly preferably 0.5% by weight to 2% by weight, of monoRL-C10C12:1, where the percentages by weight refer to the sum of all of the rhamnolipids present.

In some embodiments of the present invention, it may be advantageous and is therefore preferred if the rhamnolipid mixture composition present in the formulation according to the invention comprises, besides the aforementioned diRL-C10C10 and monoRL-C10C10 contents, 0.1% by weight to 25% by weight, preferably 2% by weight to 10% by weight, particularly preferably 4% by weight to 8% by weight, of diRL-C8C10, where the percentages by weight refer to the sum of all of the rhamnolipids present.

A particularly preferred detergent formulation according to the invention is characterized in that the rhamnolipid mixture composition comprises, besides the aforementioned diRL-C10C10 and monoRL-C10C10 contents, 0.5% by weight to 15% by weight, preferably 3% by weight to 12% by weight, particularly preferably 5% by weight to 10% by weight, of diRL-C10C12:1, 0.5 to 25% by weight, preferably 5% by weight to 15% by weight, particularly preferably 7% by weight to 12% by weight, of diRL-C10C12, 0.1% by weight to 5% by weight, preferably 0.5% by weight to 3% by weight, particularly preferably 0.5% by weight to 2% by weight, of monoRL-C10C12 and 0.1% by weight to 5% by weight, preferably 0.5% by weight to 3% by weight, particularly preferably 0.5% by weight to 2% by weight, of monoRL-C10C12:1, where the percentages by weight refer to the sum of all of the rhamnolipids present.

Over and above this, it is preferred if the rhamnolipid mixture composition present in the formulation according to the invention comprises rhamnolipids of the formula monoRL-CX or diRL-CX in only small amounts. In particular, the mixture composition according to the invention comprises preferably 0% by weight to 5% by weight, preferably 0% by weight to 3% by weight, particularly preferably 0% by weight to 1% by weight, of diRLC10, where the percentages by weight refer to the sum of all of the rhamnolipids present, and the term "0% by weight" is to be understood as meaning no detectable amount.

In some embodiments of the present invention, it is preferred that the formulations according to the invention are essentially free from a fatty oil (acylglycerols liquid at 20° C.) and therefore comprise in particular less than 0.5% by weight, especially less than 0.1% by weight, particularly preferably no detectable amounts, of a fatty oil, based on the total mixture composition.

The mixture compositions present in the formulations according to the invention can be prepared by mixing the pure substances, in which case the pure substances can be purified from conventionally prepared rhamnolipid mixtures. Corresponding purification processes are, for example, selective crystallizations and chromatographic methods. Corresponding processes are described in Heyd et al., *Development and trends of biosurfactant analysis and purification using rhamnolipids as an example*, Anal Bioanal Chem. 2008 July; 391 (5):1579-90.

In particular, the processes described below are suitable for preparing the mixture compositions present in the formulations according to the invention.

A first process comprises the process steps:

Ia) providing a *Pseudomonas putida* cell which has been genetically modified in such a way that it overexpresses in each case at least one gene of the group rhlA, rhlB and rhlC, IIa) bringing the cell according to the invention into contact with a medium comprising at least one carbon source, IIIa) cultivating the cell under conditions which allow the cell to form rhamnolipid from the carbon source, and IVa) optionally isolating the rhamnolipids formed, characterized in that the gene rhlC is overexpressed more compared to rhlB, in particular at least 1.5 times more, preferably at least 2 times more, particularly preferably at least 10 times more.

The relative intensity of the overexpression described above can be determined for example with the help of RT-PCR, in which the amount of formed mRNA is determined for the respective gene.

A person skilled in the art can achieve a regulation of the intensity of the expression in a targeted manner for example through the selection of promoters or through the use of inducible promoters in combination with an amount of inductor, or else by means of gene multiplications.

An alternative process comprises the process steps:

Ib) providing a *Pseudomonas putida* cell which has been genetically modified such that it has in each case at least one exogenous gene of the group rhlA, rhlB and rhlC, of which at least one is under the control of an inducible promoter, IIb) bringing the cell according to the invention into contact with, and cultivating it with a medium comprising at least one carbon source while achieving a cell density of 1-30 g of cell dry mass per L of fermentation broth, preferably 2-20 g of cell dry mass per L of fermentation broth, particularly preferably 5-15 g of cell dry mass per L of fermentation broth, IIIb) inducing the at least one inducible promoter and cultivating the cell under conditions which allow the cell to form rhamnolipid from the carbon source, and IVb) optionally isolating the rhamnolipids formed.

In connection with the present invention, the term "inducible promoter" is understood as meaning a promoter which changes its activity by changing the medium surrounding the cell. Changes can include for example temperature changes and concentration changes of certain substances.

In connection with the present invention, the term "inducing the at least one inducible promoter" is to be understood as meaning that the activity of the inducible promoter is increased by changing the medium surrounding the cell.

Suitable inducible promoters in connection with the present invention are, for example, promoters which are induced by adding chemical inducers (for example, lactose, IPTG, dicyclopropyl ketone, tetracyclin, doxycyclin, propionate, cumate, benzoate, arabinose, rhamnose, nicotinic acid, etc.), which are induced by altered environmental conditions (for example, a rise in phosphate or sulphur deficiency, altered temperatures or pH, etc.), or which are induced by certain physiological states (for example, certain cell densities or growth rates or phases).

Highly preferably inducible promoters that can be used in the process are selected from the group of promoters inducible by dicyclopropyl ketone, tetracyclin, doxycyclin, propionate, cumate, benzoate, phosphate deficiency, sulphur deficiency or a reduced growth rate.

The genes rhlA, rhlB and rhlC are preferably selected from those from *P. aeruginosa* in both of the processes described above.

Besides the rhamnolipid mixture composition, preferred formulations according to the invention comprise at least one further surfactant, it being possible to use, for example, anionic, nonionic, cationic and/or amphoteric surfactants, with anionic surfactants being preferred.

Preferably, from an applications-related point of view, mixtures of anionic and nonionic surfactants are present in the formulations according to the invention.

The total surfactant content of the formulation according to the invention is preferably 5 to 40% by weight and particularly preferably 9 to 35% by weight, based on the total formulation.

The nonionic surfactants used are preferably alkoxylated, advantageously ethoxylated, in particular primary alcohols having preferably 8 to 18 carbon atoms and on average 1 to 12 mol of ethylene oxide (EO) per mol of alcohol, in which the alcohol radical can be linear or preferably 2-position methyl-branched or can contain linear and methyl-branched radicals in a mixture, as are customarily present in oxo alcohol radicals. In particular, however, alcohol ethoxylates with linear radicals from alcohols of native origin having 12 to 18 carbon atoms, for example, from coconut, palm, tallow fat or oleyl alcohol, and on average 2 to 8 EO per mol of alcohol are preferred. The preferred ethoxylated alcohols include, for example, C12-C14-alcohols with 3 EO, 4 EO or 7 EO, C9-C11-alcohol with 7 EO, C13-C15-alcohols with 3 EO, 5 EO, 7 EO or 8 EO, C12-C18-alcohols with 3 EO, 5 EO or 7 EO and mixtures of these, such as mixtures of C12-C14-alcohol with 3 EO and C12-C18-alcohol with 7 EO. The stated degrees of ethoxylation are statistical average values which can be an integer or a fraction for a specific product. Preferred alcohol ethoxylates have a narrowed homolog distribution.

In addition to these nonionic surfactants, it is also possible to use fatty alcohols with more than 12 EO. Examples of such fatty alcohols are tallow fatty alcohol with 14 EO, 25 EO, 30 EO or 40 EO.

Nonionic surfactants which contain EO and PO (propylene oxide) groups together in the molecule can also be used. In this connection, it is possible to use block copolymers with EO-PO block units or PO-EO block units, but also EO-PO-EO copolymers or PO-EO-PO copolymers.

It is of course also possible to use mixed alkoxylated nonionic surfactants in which EO and PO units are not distributed blockwise, but randomly. Such products are obtainable as a result of the simultaneous action of ethylene oxide and propylene oxide on fatty alcohols.

Furthermore, alkyl glycosides can also be used as further nonionic surfactants.

A further class of nonionic surfactants, which are used either as the sole nonionic surfactant or in combination with other nonionic surfactants, are alkoxylated, preferably ethoxylated or ethoxylated and propoxylated fatty acid alkyl esters, preferably having 1 to 4 carbon atoms in the alkyl chain, in particularly fatty acid methyl esters, as are described for example in the Japanese patent application JP 58/217598 or which are preferably prepared by the process described in the international patent application WO-A-90/13533.

Nonionic surfactants of the amine oxide type, for example N-cocoalkyl-N,N-dimethylamine oxide and N-tallow-alkyl-N,N-dihydroxyethylamine oxide, and of the fatty acid alkanolamide type may also be suitable. The amount of these nonionic surfactants is preferably not more than that of the ethoxylated fatty alcohols, in particular not more than half thereof.

Further suitable surfactants are polyhydroxy fatty acid amides; the polyhydroxy fatty acid amides are substances which can usually be obtained by reductive amination of a reducing sugar with ammonia, an alkylamine or an alkanolamine and subsequent acylation with a fatty acid, a fatty acid alkyl ester or a fatty acid chloride.

The content of nonionic surfactants in the formulations according to the invention is preferably 5 to 30% by weight, preferably 7 to 20% by weight and in particular 9 to 15% by weight, in each case based on the total formulation.

The anionic surfactants used are, for example, those of the sulphonate and sulphate type. Suitable surfactants of the sulphonate type include C9-C13-alkylbenzenesulphonates, olefinsulphonates, i.e., mixtures of alkene- and hydroxyalkanesulphonates, and also disulphonates, as are obtained, for example, from C12-C18-monoolefins with a terminal or internal double bond by sulphonation with gaseous sulphur trioxide and subsequent alkaline or acidic hydrolysis of the sulphonation products.

Also of suitability are alkanesulphonates which are obtained from C12-C18-alkanes, for example by sulphochlorination or sulphoxidation with subsequent hydrolysis or neutralization.

Similarly, the esters α-sulpho fatty acids (ester sulphonates), for example the α-sulphonated methyl esters of hydrogenated coconut, palm kernel or tallow fatty acids, are also suitable.

Further suitable anionic surfactants are sulphated fatty acid glycerol esters. Fatty acid glycerol esters are to be understood as meaning the mono-, di- and triesters, and also mixtures thereof, as are obtained in the preparation by esterification of a monoglycerol with 1 to 3 mol of fatty acid or in the transesterification of triglycerides with 0.3 to 2 mol of glycerol. Preferred sulphated fatty acid glycerol esters are the sulphation products of saturated fatty acids having 6 to 22 carbon atoms, for example of caproic acid, caprylic acid, capric acid, myristic acid, lauric acid, palmitic acid, stearic acid or behenic acid.

Preferred alk(en)yl sulphates are the alkali metal and in particular the sodium salts of the sulphuric acid half-esters of the C12-C18-fatty alcohols, for example, from coconut fatty alcohol, tallow fatty alcohol, lauryl, myristyl, cetyl or stearyl alcohol or the C10-C20-oxo alcohols and those half-esters of secondary alcohols of these chain lengths. Furthermore, preference is given to alk(en)yl sulphates of the specified chain length which contain a synthetic straight-chain alkyl radical prepared on a petrochemical basis, and which have an analogous degradation behavior to the suitable compounds based on fatty chemical raw materials. From the point of view of washing, the C12-C16-alkyl sulphates and C12-C18-alkyl sulphates and also C14-C18-alkyl sulphates are preferred. 2,3-Alkyl sulphates, which are prepared for example in accordance with the U.S. Pat. Nos. 3,234,258 or 5,075,041 and can be obtained as commercial products of the Shell Oil Company under the name DAN®, are also suitable anionic surfactants.

The sulphuric acid monoesters of the straight-chain or branched C7-C20-alcohols ethoxylated with 1 to 6 mol of ethylene oxide, such as 2-methyl-branched C9-C11-alcohols having on average 3.5 mol of ethylene oxide (EO) or C12-C18-fatty alcohols with 1 to 4 EO, are also suitable. On account of their high foaming behavior, they are used in cleaning compositions only in relatively small amounts, for example in amounts of from 1 to 5% by weight.

Further suitable anionic surfactants are also the salts of alkylsulphosuccinic acid, which are also referred to as sulphosuccinates or as sulphosuccinic acid esters and constitute the monoesters and/or diesters of sulphosuccinic acid with alcohols, preferably fatty alcohols and in particular ethoxylated fatty alcohols. Preferred sulphosuccinates contain C8-C18-fatty alcohol radicals or mixtures of these. Particularly preferred sulphosuccinates contain a fatty alcohol radical which is derived from ethoxylated fatty alcohols. In this connection, sulphosuccinates whose fatty alcohol radicals are derived from ethoxylated fatty alcohols with a narrow homolog distribution are particularly preferred in turn. It is likewise also possible to use alk(en)ylsuccinic acid having preferably 8 to 18 carbon atoms in the alk(en)yl chain or salts thereof.

Particularly preferred anionic surfactants are soaps. Also of suitability are saturated and unsaturated fatty acid soaps, such as the salts of lauric acid, myristic acid, palmitic acid, stearic acid, (hydrogenated) erucic acid and behenic acid, and also soap mixtures derived in particular from natural fatty acids, for example, coconut, palm kernel, olive oil or tallow fatty acid.

The anionic surfactants including the soaps can be in the form of their sodium, potassium or ammonium salts, as well as soluble salts of organic bases, such as mono-, di- or triethanolamine. Preferably, the anionic surfactants are in the form of their sodium or potassium salts, in particular in the form of the sodium salts.

The content of anionic surfactants in the formulation according to the invention is preferably 2 to 30% by weight, preferably 4 to 25% by weight and in particular 5 to 22% by weight, based on the total formulation.

Amphoteric surfactants which can be used according to the invention are those surface-active compounds which carry at least one quaternary ammonium group and at least one —$COO^-$— or —$SO_3^-$ group in the molecule. Particularly preferred amphoteric surfactants in this connection are betaine surfactants such as alkyl- or alkylamidopropylbetaines. In particular, betaines such as the N-alkyl-N,N-dimethylammonium glycinates, e.g. the cocoalkyldimethylammonium glycinate, N-acylaminopropyl-N,N-dimethylammonium glycinates, e.g., the cocoacylaminopropyldimethylammonium glycinate, the C12-C18-alkyldimethylacetobetaine, the cocoamidopropyldimethylacetobetaine, 2-alkyl-3-carboxymethyl-3-hydroxyethylimidazolines and sulphobetaines having in each case 8 to 18 carbon atoms in the alkyl- or acyl group, and also the cocoacylaminoethylhydroxyethylcarboxymethyl glycinate are preferred.

A particularly preferred zwitterionic surfactant is the N,N-dimethyl-N-(lauroylamidopropyl)ammoniumacetobetaine known under the INCI name Cocamidopropyl Betaine.

Further suitable amphoteric surfactants are formed by the group of amphoacetates and amphodiacetates, in particular, for example, coco- or laurylamphoacetates or -diacetates, the group of amphopropionates and amphodipropionates, and the group of amino acid-based surfactants such as acyl glutamates, in particular disodium cocoyl glutamate and sodium cocoyl glutamate, acyl glycinates, in particular cocoyl glycinates, and acyl sarcosinates, in particular ammonium lauroyl sarcosinate and sodium cocoyl sarcosinate.

Particularly preferred detergent formulations according to the invention are characterized in that the surfactant is selected from the group of sulphonates and sulphates, preferably the linear alkylbenzenesulphonates, in particular from the group of the $C_9$-$C_{13}$ alkylbenzenesulphonates, very particularly preferably sodium (n-$C_{10}$-$C_{13}$)-alkylbenzenesulphonate.

In addition to the surfactants, the detergent formulations can comprise further ingredients that can further improve the application-related and/or aesthetic properties of the detergent formulation. Within the context of the present invention, preferred detergent formulations additionally comprise one or more substances from the group of builders, bleaches, bleach activators, enzymes, perfumes, perfume carriers, fluorescent agents, dyes, foam inhibitors, silicone oils, antiredeposition agents, optical brighteners, greying inhibitors, shrink preventers, anticrease agents, colour transfer inhibitors, antimicrobial active ingredients, germicides, fungicides, antioxidants, preservatives, corrosion inhibitors, antistats, bittering agents, ironing aids, phobicization and impregnation agents, swelling and slip-resist agents, neutral filling salts, and UV absorbers.

Examples of builders, bleaches, bleach activators, bleach catalysts and enzymes are described in WO 2007/115872, page 22, line 7 to page 25, line 26, the explicit disclosure of which in this regard is incorporated into this disclosure by virtue of this reference. Antiredeposition agents, optical brighteners, greying inhibitors, color transfer inhibitors are described by way of example in WO 2007/115872 on page 26, line 15 to page 28, line 2, the explicit disclosure of which in this regard forms part of this disclosure by virtue of this reference. Examples of anticrease agents, antimicrobial active ingredients, germicides, fungicides, antioxidants, preservatives, antistats, ironing aids, UV absorbers are described by way of example in WO 2007/115872 on page 28, line 14 to page 30, line 22, the explicit disclosure of which in this regard forms part of this disclosure by virtue of this reference.

In particular, the detergent formulations can comprise between 0.001 and 90, particularly preferably 0.01 to 45% by weight, of one or more of the further ingredients specified here, with the percentages by weight referring to the total detergent formulation.

The detergent formulations according to the invention can advantageously be used for increasing the rate of foam formation and/or for foam stabilization. Preferably, the detergent formulations according to the invention are used for foam stabilization, in which case this use according to the invention is carried out in particular in the presence of soil.

Within the context of the aforementioned use according to the invention for increasing the rate of foam formation and/or for foam stabilization, preference is given to using the detergent formulations which are specified above as preferred detergent formulations.

The present invention likewise provides the use of the rhamnolipid mixture compositions present in the detergent formulations according to the invention for increasing the rate of foam formation and/or for foam stabilization. Preferably, the rhamnolipid mixture compositions present in the detergent formulations according to the invention are used for foam stabilization, in which case this use according to the invention is carried out in particular in the presence of soil.

Within the context of the aforementioned use according to the invention for increasing the rate of foam formation and/or for foam stabilization, the rhamnolipid mixture compositions are preferably used which are present in the detergent formulations specified above as preferred.

The present invention further provides the use of a detergent formulation according to the invention for preventing greying of a textile and/or as antiredeposition agent. Within the context of the aforementioned use according to the invention for preventing greying of a textile and/or as antiredeposition agent, the detergent formulations are preferably used which are specified above as preferred detergent formulations.

The present invention yet further provides the use of at least one rhamnolipid for preventing greying of a textile and/or as antiredeposition agent, preference being given to using the rhamnolipid mixture compositions present in the detergent formulations according to the invention. Particularly preferably, within the context of the aforementioned use according to the invention for preventing greying of a textile and/or as antiredeposition agent, preference is given to using the rhamnolipid mixture compositions which are present in the detergent formulations specified above as preferred.

The examples listed below describe the present invention by way of example, without limiting the invention, the scope of application of which arises from the entire description and the claims, to the embodiments specified in the examples.

EXAMPLES

Example 1

Preparation of Rhamnolipids with rhlABC from *P. Aeruginosa* PAO1 in *P. Putida*, where the Expression of the Gene Coding for the Rhamnosyltransferase RhlC is Many Times More than that of the Gene rhlB Coding for the Rhamnosyltransferase RhlB In order to prepare rhamnolipids with rhlABC from *P. aeruginosa* PAO1 in a *P. putida*-strain in which the expression of the gene coding for the rhamnosyltransferase RhlC takes place to a much greater extent than that of the gene rhlB coding for the rhamnosyltransferase RhlB, the plasmid pBBR1MCS2-Plac-rhlABC-T-Ptac-rhlC-T (Seq ID No. 1) is constructed.

For this, the following DNA fragments were synthesized: *P. aeruginosa* PAO1 genes rhlA, rhlB and rhlC, followed by a terminator, followed by the synthetic tac promoter, followed by the *P. aeruginosa* PAO1 genes rhlC and a terminator, flanked by a HindIII restriction site (5' end) or Bsu36I restriction site (3' end) (Seq ID No. 2).

The vectors provided by the DNA synthesis provider and which contain the synthesized DNA fragment were cleaved with HindIII and Bsu36I and ligated into the vector pBBR1MCS-2 (Seq ID 3), likewise cleaved with HindIII and Bsu36I, by means of a Fast Link Ligation Kit (Epicentre Technologies; Madison, Wis., USA). The resulting target vector pBBR1MCS2-Plac-rhlABC-T-Ptac-rhlC-T (pBBR1MCS-2 with synthesized fragment Seq ID No. 2) had a size of 9336 base pairs.

The transformation of *Pseudomonas putida* KT2440 with the vector pBBR1MCS2-Plac-rhlABC-T-Ptac-rhlC-T (Seq ID No. 1) took place as described above (Iwasaki et al. Biosci. Biotech. Biochem. 1994. 58(5):851-854). The plasmid DNA from 10 clones in each case was isolated and analyzed. The resulting strain carrying the plasmid was called *P. putida* KT2440 pBBR1MCS2-Plac-rhlABC-T-Ptac-rhlC-T.

The recombinant strain *P. putida* KT2440 pBBR1MCS2-Plac-rhlABC-T-Ptac-rhlC-T was cultivated on LB-agar-canamycin (50 μg/ml) plates.

For the production of the rhamnolipids, the medium referred to below as M9 medium was used. This medium consists of 2% (w/v) glucose, 0.3% (w/v) $KH_2PO_4$, 0.679% $Na_2HPO_4$, 0.05% (w/v) NaCl, 0.2% (w/v) $NH_4Cl$, 0.049% (w/v) $MgSO_4 \times 7\ H_2O$ and 0.1% (v/v) of a trace element solution. This consists of 1.78% (w/v) $FeSO_4 \times 7\ H_2O$, 0.191% (w/v) $MnCl_2 \times 7\ H_2O$, 3.65% (w/v) HCl, 0.187% (w/v) $ZnSO_4 \times 7\ H_2O$, 0.084% (v/v) Na-EDTA×2 $H_2O$, 0.03% (v/v) $H_3BO_3$, 0.025% (w/v) $Na_2MoO_4 \times 2\ H_2O$ and 0.47% (w/v) $CaCl_2 \times 2\ H_2O$. The pH of the medium was adjusted to 7.4 with $NH_4OH$ and the medium was consequently sterilized by means of an autoclave (121° C., 20 min). Adjustment of the pH during the cultivation was not necessary.

To investigate the rhamnolipid production in the shake flask, firstly a preculture was prepared. For this, a colony of a strain freshly streaked on LB-agar plate was used and 10 ml of LB medium was inoculated in a 100 ml Erlenmeyer flask. All of the recombinant *P. putida* strains were cultivated in the LB medium to which 50 μg/ml of canamycin was added. The *P. putida* strains were cultivated overnight at 30° C. and 200 rpm.

The precultures were used in order to inoculate 50 ml of M9 medium (+50 μg/ml canamycin) in the 250 ml Erlenmeyer flask (starting $OD_{600}$ 0.1). The cultures were cultivated at 200 rpm and 30° C. After 24 h, a sample of 1 ml of culture broth was removed from the culture flask.

Fermentation and Purification

A mineral medium (M9) was likewise used for the main culture. The fermentation following inoculation with 10% by volume of preculture and consumption of the initially introduced glucose took place with carbon limitation via a glucose feeding in a 2 liter fermenter with an operating volume of 1.2 L. The glucose feeding took place by reference to the dissolved oxygen signal. The dissolved oxygen was regulated at 20% saturation via the stirrer speed. The pH was regulated to 7 via a pH electrode and addition of $NH_4SO_4$. The fermentation was conducted over 4 days to a bio dry mass of 15 g/l. The rhamnolipid concentration was ascertained via HPLC and was 9.8 g/l. After separating off the cells by means of centrifugation at 10 000 g, the fermentation broth was adjusted to a pH of 4.0 by adding concentrated HCl. Extraction was then carried out with the same volume of ethyl acetate. The rhamnolipid-containing organic phase was separated off and further processed. The pH of the solution was adjusted to pH 7 by adding 50% strength by weight KOH (aq). This resulted in the formation of two liquid phases. The lower phase contained the rhamnolipids freed from lipophilic and hydrophilic impurities in high yield. The composition of the rhamnolipid mixture was not influenced as a result of this. The lower phase was drawn off and the solvent was largely removed on a rotary evaporator. Water was then added again and the aqueous rhamnolipid solution was freeze-dried. The resulting powder was analyzed by means of HPLC and characterized as to application.

Quantification of Rhamnolipids

Sample preparation for the following chromatographic analyses took place as follows. A displacement pipette (Combitip) was used to initially introduce 1 ml of acetone in a 2 ml reaction vessel, and the reaction vessel was closed immediately to minimize evaporation. Next, 1 ml of culture broth was added. After vortexing the culture broth/acetone mixture, it was centrifuged for 3 min at 13 000 rpm, and 800 μl of the supernatant was transferred to a HPLC vessel.

For the purposes of detection and quantification of rhamnolipids, an evaporative light scattering detector (Sedex LT-ELSD model 85LT) was used. The actual measurement was carried out by means of Agilent Technologies 1200 Series (Santa Clara, Calif.) and the Zorbax SB-C8 Rapid Resolution Column (4.6×150 mm, 3.5 μm, Agilent). The injection volume was 5 μl and the run time of the method was 20 min. The mobile phase used aqueous 0.1% TFA (trifluoroacetic acid, solution A) and methanol (solution B). The column temperature was 40° C. Serving as detectors were the ELSD (detector temperature 60° C.) and the DAD (diode array, 210 nm). The gradient used in the method was:

| t [min] | Solution B % by volume | Flow rate [ml/min] |
|---|---|---|
| 0.00 | 70% | 1.00 |
| 15.00 | 100% | 1.00 |
| 15.01 | 70% | 1.00 |
| 20.00 | 70% | 1.00 |

The rhamnolipid composition from *P. putida* KT2440 pBBR1MCS2-Plac-rhlABC-T-Ptac-rhlC-T obtained with the process described above comprises:

diRL-C10C10 81% by weight
diRL-C10C12 10% by weight
diRL-C10C12:1 8% by weight
monoRL-C10C10 1% by weight resulting in a weight ratio of di-rhamnolipids to mono-rhamnolipids of 99:1.

Example 2

Application-Related Testing—Description of the Method

The stirrer with a holder for 4 sealable cylinders with a volume of 300 ml was placed at an angle of 90°. The 300 ml measuring cylinders with seal were arranged such that rotation of the cylinders took place horizontally. Before the actual measurement, the measuring cylinders were wetted with the surfactant solution. This solution was then discarded.

Into each measuring cylinder were poured, as far as possible foam-free, 60 ml of each of the surfactant solutions to be tested. The sealed measuring cylinders were secured in the corresponding holders and the mixing device was started at 20 rpm. At the same time, a stopwatch was activated. In order to measure the foam heights as a function of time, after the corresponding time intervals, the mixer was stopped, and after waiting for 30 seconds the foam height was noted.

If the foaming behavior was to be observed with soil contamination, then the soil was added at defined times.

In all cases, the concentration of the surfactant was 0.4 g of active substance per liter of solution.

The solution was then shaken in each case for 2 min without the addition of soil in the cylinder. The first portion of soil was then added, followed by shaking for a further 10 min. After reading off the foam height, the second defined amount of soil was added and the mixture was shaken for a further 10 min. After reading off the foam height, the third defined amount of soil was added, followed by shaking for a further 10 min and measurement of the foam height.

The measured foam heights were averages from 4 individual measurements.

The soil used was standard soil fabric SBL 2004 from wfk Testgewebe GmbH in Krefeld. The soil loading of the fabric was 8 g of soil per fabric section (certified by wfk Testgewebe GmbH in Krefeld). SBL 2004 is a widespread industry soil standard for investigating the detergency of detergents in the presence of soil.

The typical composition of the standard soil according to company information from wfk Testgewebe GmbH was as follows:

18.4% olive oil (Olio Extra Vergine di Oliva)
18.4% synthetic sebum according to Bey
9.4% kaolin
9.2% protein (from protein powder)
8.0% bleach consuming agent
6.9% starch
6.9% salt
6.9% mineral oil
6.9% lanolin
2.8% emulsifier (Uniperol® dispersant, trade name of BASF SE)
2.3% urea (synthetic)
2.0% quartz
1.8% calcium chloride
0.075% soot
0.025% iron oxide Example 3

Foaming Ability without Soil Addition

Conditions:

Water hardness: Measured in degrees of German hardness ° dH, ratio of Ca and Mg=2:1 molar M Water 5° dH, 0.4 g/L active concentration of surfactant.

Measurement values of foam height after the stated number of minutes:

| Surfactant | °dH | 2 min | 5 min | 10 min | 15 min | 20 min | 25 min | 30 min |
|---|---|---|---|---|---|---|---|---|
| LAS | 5 | 185 | 200 | 225 | 230 | 235 | 235 | 235 |
| Ex. 1 | 5 | 162 | 200 | 227 | 227 | 227 | 227 | 227 |
| Jeneil | 5 | 152 | 198 | 200 | 200 | 200 | 200 | 200 |

Surfactants used:

LAS=MARLON ARL® from Sasol, sodium (n-$C_{10}$-$C_{13}$)-alkylbenzenesulphonate with an active content of 80% by weight, is a known, high-foaming anionic surfactant which is used widely in detergent formulations.

Jeneil: Commercial sample with a high mono-rhamnolipid fraction

The composition of Example 1 exhibited a somewhat slower foaming behavior, but achieved as good a level as the anionic surfactant LAS after 10 min Jeneil with its high monoRL fraction and low diRL fraction exhibited a slower foaming behavior than Example 1, which has a low monoRL fraction and a high diRL fraction, and at the end also achieves only a distinctly smaller foam level than LAS or Example 1.

Example 4

Foaming Behavior in the Presence of Soil

Upon the triple addition (cf. Example 2) of 76 mg of soil in each case to a cylinder, the composition of Example 1 compared to LAS exhibits, after 15 min, a somewhat higher foam formation than LAS. After the third soil addition (after 20 min), the foam height is still stable and considerably higher than in the case of LAS. The commercial sample of Jeneil exhibits a reduced foaming behavior, even without the addition of soil, compared with LAS or the composition of Example 1 (=foam height at 2 min)

Measurement values for foam height after the stated number of minutes:

| Surfactant | °dH | 2 min | 5 min | 10 min | 15 min | 20 min | 25 min | 30 min |
|---|---|---|---|---|---|---|---|---|
| LAS | 5 | 165 | 20 | 18 | 9 | 7 | 4 | 4 |
| Ex. 1 | 5 | 162 | 17 | 17 | 10 | 10 | 10 | 10 |
| Jeneil | 5 | 132 | 20 | 20 | 10 | 10 | 10 | 10 |

Example 5

Foaming Behavior of Mixtures of LAS and Rhamnolipids

Soil contamination: 3×76 mg for 0.4 g/L of active substance surfactant. Mixtures of LAS and composition of Example 1 in the stated weight ratios were used.

Measurement values of foam height after the stated number of minutes:

| Surfactant | °dH | 2 min | 5 min | 10 min | 15 min |
|---|---|---|---|---|---|
| LAS | 5 | 165 | 20 | 18 | 9 |
| Ex. 1 | 5 | 162 | 17 | 17 | 10 |
| LAS/Ex. 1 75:25 | 5 | 167 | 20 | 18 | 10 |
| LAS/Ex. 1 50:50 | 5 | 193 | 34 | 22 | 12 |
| LAS/Ex. 1 25:75 | 5 | 182 | 41 | 25 | 12 |

Without soil addition in the foaming behavior, i.e., in the build up of foam, the mixtures of LAS and of the composition in Example 1 exhibited a distinctly higher foam volume than the respective component on its own. After the first soil addition (at t=2 min), the mixtures of LAS and of the composition in Example 1 in the ratio 50:50 (w/w) and 25:75 (w/w) exhibited a distinctly higher foam volume and an increased foam stability compared with the respective component on its own.

It was therefore shown that mixtures of LAS and rhamnolipids behave in a positively synergistic manner as regards foaming behavior.

Example 6

Detergency

The effectiveness of stain removal was ascertained in a Lini washing device (principle: closed metal drums which are agitated in a heated water bath around a horizontal axis) on various, aesthetically soiled test fabrics.

Types of soil used (cotton fabric with patches of soiling):

| Soiling | Manufacturer/Supplier | Order No. |
|---|---|---|
| Soya | wfk | 10080 |
| Curry | wfk | 10075 |
| Soot | EMPA | 114 |
| Sebum | wfk | 10013 |
| Milk/cocoa | wfk | 10017 |

wfk = wfk Testgewebe GmbH, Krefeld

EMPA = Eidgenossische Materialprufanstalt [Swiss Federal Laboratories for Materials Science and Technology]

A Datacolor Elrepho SF450 spectrophotometer with ColorTools evaluation software was used to measure the reflection of the test fabric before and after washing. Here, with the assistance of the CIE-Lab color space classification, the lightness L*, the value a* on the red-green color axis and the value b* on the yellow-blue color axis are measured before and after washing.

The change in color value (ΔE value) here is a measure of the attained cleaning effect.

The ΔE value was defined as and was calculated, with the calculation taking place automatically via the ColorTools evaluation software, by means of the following formula $$\Delta E=\sqrt{((\Delta a^*)^2+(\Delta b^*)^2+(\Delta L^*)^2)}$$

i.e., the better the soil removal, the larger the ΔE value.

The following classification can be used for the efficiency of the stain removal:

| ΔE value | Description |
|---|---|
| >2 | Visually ascertainable reduction in soiling |
| 4-10 | Moderate stain removal |
| 10-20 | Significant stain removal |
| >20 | Complete stain removal |

The conditions of the washing experiments were as follows:

| | |
|---|---|
| Wash liquor: | Composition cf. table below |
| Water hardness: | 16° dH |
| Liquor volume: | 200 ml |
| Washing container: | 500 ml |
| Fabric load per wash container: | 3 soilings of one sort (10 × 10 cm) and 1 white cotton fabric (10 × 20 cm). The size of the cloths should be adapted such that they weigh about 10 g together with the white cotton fabric. (Liquor ratio 1:20) |
| Washing mechanics: | 10 steel balls Ø 6 mm |
| Washing temperature: | 25° C. |
| Washing time: | 30 min |
| Rinsing: | 3 × 30 s with tap water (ca. 5° dH) |

In order to obtain significant measurement results, the washing operations were carried out 3× with each detergent formulation on each soiling, i.e., 9 test fabrics were washed per detergent formulation for each type of soil.

Detergent Formulation A:

| | Concentration % by weight (100% active base) |
|---|---|
| Ex. 1 | 37.60 |
| Glycerol | 5 |
| Propylene glycol | 9 |
| Triethanolamine | 11.05 |
| Citric acid | 1.71 |
| Water | Remainder |

The detergent formulations were adjusted to pH 8.2 with sodium hydroxide solution. As comparison, a commercial Persil® Universal Gel from Henkel was used. Persil Universal Gel was used in accordance with the dose recommendation 40 ml/10 L. For detergent formulation A, the overall surfactant concentration in the wash liquor was 0.5 g/L.

Results of the Stain Removal:

| | ΔE values | | | | |
|---|---|---|---|---|---|
| Stain | Soya | Curry | Soot | Sebum | Milk/cocoa |
| Persil ® | 23.98 | 3.7 | 3.97 | 4.57 | 13.11 |
| A | 24.69 | 3.34 | 3.48 | 3.67 | 11.14 |

A detergent formulation comprising, as effective surfactant, exclusively a composition in Example 1 was just as effective with regard to the stain removal of soya, curry, soot and sebum as a commercial liquid detergent based on an optimized surfactant ratio of LAS, further anionic surfactants and nonionic surfactants.

Example 7

Greying Inhibition/Antiredeposition of Soil

Measurement of greying or antiredeposition of soil:

A further important aspect for the cleaning of textiles is that soil which is dispersed, dissolved or emulsified in the wash liquor does not settle again on clean fabric. This undesired deposition effect is known as greying.

In order to be able to measure this effect, a clean white cotton cloth was washed as well (see above) in all of the washing experiments and then the ΔE value of this was likewise measured. In this case, the reciprocal ΔE value produces a measure of greying; the lower the reciprocal ΔE value, the lower the greying.

| | 1ΔE values | | | | |
|---|---|---|---|---|---|
| Stain | Soya | Curry | Soot | Sebum | Milk/cocoa |
| Persil ® | 0.14 | 0.12 | 0.18 | 0.28 | 0.30 |
| A | 0.15 | 0.10 | 0.15 | 0.35 | 0.22 |

It can clearly be seen that rhamnolipids of the specific composition in Example 1 exhibited a lower greying effect for curry, soot, milk/cocoa than the commercial liquid detergent formulated on the basis of LAS and therefore act as antiredeposition agents.

While the present invention has been particularly shown and described with respect to various embodiments thereof, it will be understood by those skilled in the art that the foregoing and other changes in forms and details may be made without departing from the spirit and scope of the present invention. It is therefore intended that the present invention not be limited to the exact forms and details described and illustrated, but fall within the scope of the appended claims.

What is claimed is:

1. A detergent formulation for textiles, comprising a mono- and di-rhamnolipid mixture composition, wherein a weight ratio of said di-rhamnolipids to said mono-rhamnolipids is greater than 97:3.

2. The detergent formulation according to claim 1, wherein said rhamnolipid mixture composition comprises 51% by weight to 95% by weight of diRL-C10C10, and 0.5% by weight to 9% by weight of monoRL-C10C10, where the percentages by weight refer to the sum of all of the rhamnolipids present.

3. The detergent formulation according to claim 2, wherein said rhamnolipid mixture composition further comprises 0.5% by weight to 15% by weight of diRL-C10C12:1, where the percentages by weight refer to the sum of all of the rhamnolipids present.

4. The detergent formulation according to claim 2, wherein said rhamnolipid mixture composition further comprises 0.5 to 25% by weight of diRL-C10C12, where the percentages by weight refer to the sum of all of the rhamnolipids present.

5. The detergent formulation according to claim 2, wherein said rhamnolipid mixture composition further comprises 0.1% by weight to 5% by weight of monoRL-C10C12, and 0.1% by weight to 5% by weight of monoRL-C10C12:1, where the percentages by weight refer to the sum of all of the rhamnolipids present.

6. The detergent formulation according to claim 2, wherein said rhamnolipid mixture composition further comprises 0.5% by weight to 15% by weight of diRL-C10C12:1, 0.5 to 25% by weight of diRL-C10C12, 0.1% by weight to 5% by weight of monoRL-C10C12 and 0.1% by weight to 5% by weight of monoRL-C10C12:1, where the percentages by weight refer to the sum of all of the rhamnolipids present.

7. The detergent formulation according to claim 2, wherein said rhamnolipid mixture composition further comprises 0% by weight to 5% by weight of diRLC10, where the percentages by weight refer to the sum of all of the rhamnolipids present.

8. The detergent formulation according to claim 1, further comprising a surfactant.

9. The detergent formulation according to claim 8, wherein said surfactant is selected from the group consisting of anionic surfactants, cationic surfactants, nonionic surfactants and amphoteric surfactants.

10. The detergent formulation according to claim 8, wherein said surfactant is selected from the group of sulphonates and sulphates.

11. The detergent formulation according to claim 10, wherein said surfactant is a liner alkylbenzenesulphonate.

12. A method of washing textiles comprising adding a detergent formulation according to claim 1 to said textiles.

* * * * *